US010970959B2

(12) United States Patent
Little

(10) Patent No.: US 10,970,959 B2
(45) **Date of Patent: *Apr. 6, 2021**

(54) ELECTRONIC DEVICE FOR PLAYING A REEL-BASED GAME WITH MINI-REELS

(71) Applicant: Lightning Box Games Pty Ltd, Ultimo (AU)

(72) Inventor: David Anthony Little, Waterloo (AU)

(73) Assignee: Lightning Box Games Pty Ltd, Ultimo (AU)

( * ) Notice: Subject to any disclaimer, the term of this patent is extended or adjusted under 35 U.S.C. 154(b) by 19 days.

This patent is subject to a terminal disclaimer.

(21) Appl. No.: 16/266,028

(22) Filed: Feb. 2, 2019

(65) Prior Publication Data

US 2019/0172306 A1 Jun. 6, 2019

Related U.S. Application Data

(63) Continuation of application No. 14/304,989, filed on Jun. 16, 2014, now Pat. No. 10,235,828.

(60) Provisional application No. 61/836,109, filed on Jun. 17, 2013.

(51) Int. Cl.
*G07F 17/32* (2006.01)
*G07F 17/34* (2006.01)

(52) U.S. Cl.
CPC ..... *G07F 17/3213* (2013.01); *G07F 17/326* (2013.01); *G07F 17/34* (2013.01); *G07F 17/32* (2013.01)

(58) Field of Classification Search
CPC .... G07F 17/3213; G07F 17/326; G07F 17/34; G07F 17/32
See application file for complete search history.

*Primary Examiner* — Kevin Y Kim
(74) *Attorney, Agent, or Firm* — Michael A Cantor

(57) ABSTRACT

The present invention is a device embodying a reel-based game. The reel-based game includes a plurality of reels and a plurality of mini-reels. The mini-reels replace one or more of the plurality of reels or may replace one or more symbol-bearing positions of the reels. The added feature of the plurality of mini-reels enables the possible attainment of a greater number of symbol combinations and winning outcomes by replacing standard paylines associated with the reel or reel position with sets of paylines that cover all mini-reel-based outcomes.

10 Claims, 7 Drawing Sheets

| | R1 | R2 | R3 | R4 | R5 |
|---|---|---|---|---|---|
| P1 | QUEEN | BAR | QUEEN | JACK | JACK |
| P2 | DIAMOND | NINE | DIAMOND | BAR | KING |
| P3 | **JACK** | **JACK** | **JACK** | NINE | ACE |

FIG. 5

| | R1 | R2 | R3 | R4 | R5 |
|---|---|---|---|---|---|
| P1 | QUEEN | BAR | QUEEN | **JACK** | **JACK** |
| P2 | DIAMOND | NINE | DIAMOND | BAR | KING |
| P3 | **JACK** | **JACK** | **JACK** | NINE | ACE |

FIG. 6

ELECTRONIC DEVICE FOR PLAYING A REEL-BASED GAME WITH MINI-REELS

PRIORITY CLAIM

This application claims priority to U.S. patent application Ser. No. 14/304,989 filed on Jun. 16, 2014 which claims priority to U.S. Provisional Patent Application Ser. No. 61/836,109 filed Jun. 17, 2013, which are incorporated by reference herein.

FIELD OF THE INVENTION

The present invention relates generally to a gaming device for playing wagering games, and more particularly, to reel-based wagering game that provides multiple mini-reels in the place of one or more reels to provide more possibilities to achieve winning outcomes.

BACKGROUND

Slot machines have been a form of entertainment for many decades. They began as strictly mechanical machines but later developed into electro-mechanical and electronic gaming devices that displayed the slot machine game as graphic and video images on a computer screen. With the advent of electronic gaming machines, the game designer was no longer restricted to the limitations imposed by mechanical devices but could now develop many new and exciting features, limited only by the processing power and memory of the electronic machine, and the designer's creativity.

It has always been a goal of the game designer to develop games of ever-increasing entertainment value. The greater the entertainment value the greater the machine's use and, generally, the greater revenue received by the slot machine provider. Therefore, the power of the electronic gaming machine was tapped to create not only games with colorful graphic displays and animations, but also to add bonus games and other features. These bonuses and features not only further increased the level of entertainment but also provided a perceived benefit to the player—a chance to win more.

Thus, numerous bonus games and other game features have been developed over the years to enhance overall play of the games. There is a continual effort to create newer and better bonuses and features to attract players to those games that possess such and to cause the player to want to continue playing the game for extended periods of time.

One example of a common bonus game that has been developed is the "pick 'em" game. In that bonus game, the player generally selects icons with various hidden awards that are revealed once selected. Typically, one or more icons will reveal a termination symbol that ends the bonus. The player collects the awards won until such time as the bonus game is terminated. Many variations on this basic bonus game have been developed, but need not be described here. Another common bonus game is a "free spin bonus". As the name suggests, upon entering the bonus, the player is awarded a certain number of free spins. The symbol sets and award outcomes used in the free spin game may be the same or different from those used in the base game that triggered the free spin bonus. Some outcomes may add to or decrease the number of free spins awarded. Again, this is a description of a basic free spin bonus game. Many variations on this type of bonus have been developed, but need not be described here. The basic "pick 'em" and "free spin bonus" are just two examples of a myriad of bonus games developed by game designers and developers. Bonus games can be triggered as a result of the outcome of the base game, randomly, or based on some other criteria unrelated to the play of the game, such as amount of time spent playing at that casino or at that particular slot machine.

In addition to bonus games, various features have been developed to enhance the play of the base game. One of the first such features was in regards to paylines. Initially, games had only one line on which a player could bet. Therefore, outcomes were based on symbol combinations along that line. The line usually was made up by envisioning an imaginary line across the center row of symbols. Gradually more paylines became popular, starting with three paylines, then five paylines and now more than 100 paylines, any of which can be played during a given play of the game.

As a more modern example, a feature know as Split Symbols® by game developer and manufacturer IGT has been used to put multiple symbols in one position of the symbol matrix thus establishing multiples of the same symbols along the payline from the one position as opposed to just one symbol. These Split Symbol games can therefore result in greater wins since more symbols can thus lie along the payline to potentially create greater awards and a higher award frequency. Another example is symbol stacking. In such games, sections of virtual reels may be randomly replaced or replaced based on a given outcome with symbols of a kind thus creating a display of like symbols throughout the symbol matrix. This creates a real or perceived likelihood of greater winning outcomes.

Features associated with adding additional reels or unique reels to games have also been designed and developed. A system known as Reel Power® allows for a single line game to be played with only the center row being displayed in the window. The other positions on the window are partially covered so that the player can see that a prize is not included in that part of the window. When only one line is being played, a prize award is not included in the win if it did not appear on the displayed line, as the window was not open to include other positions in the win. A gaming machine using Reel Power® is disclosed in U.S. Pat. No. 6,093,102.

With Reel Power® the player can elect to pay extra to include all positions on the reel to determine the win. However, by including the extra positions on the reel for use in determining a win, the player in fact only pays for what is otherwise a scatter win in a scatter game—a symbol that has potential award value without residing along a payline—but with all symbols being scatter symbols. This provides added possibilities for wins, but in a limited manner.

Money Burst® is another reel-based game feature developed by WMS and disclosed in U.S. Pat. No. 8,608,544. Money Burst uses a lesser number of positions in the initial reels causing all paylines to run through these positions resulting in higher volatility and player excitement. Thus, the symbol matrix is modified from the standard 3×3, 3×5, 4×5, or the like, to, for example, a 2×2 alongside a 3×4 matrix.

A feature known as "replacement reels" were disclosed in U.S. Pat. No. 8,529,333 to King Show Games. That patent appears to discuss replacement upon a triggering occurrence of one symbol of the standard matrix with a replacement reel that is independent from the primary reel associated with the given column of the symbol matrix. The replacement reel is "spun" to provide a new randomly selected symbol at the given position.

The present invention improves on the slot machine gaming experience by adding yet another additional feature based on extra mini-reels that may be included in calculating awards without merely adding additional positions. In previous games where an extra reel was added, the award was increased due to the difficulty of getting more symbols to match up. For instance, some games added a $6^{th}$ reel, which meant the player could then be awarded a six-of-a-kind prize for matching symbols on all six reels. The extra mini-reels in the present invention go beyond that to include multiple reels within a reel, without merely replacing the symbol positions of the reel with a mini-reel, and thus provides a multitude of different possibilities for a win.

SUMMARY

The present invention is directed to a gaming device that provides a feature for improving upon a reel-based video slot machine game. In a reel-based video slot machine game, a series of reels, each having distinct positions, generally allocate symbols randomly selected from a symbol set to each of the positions. In a video-based slot machine game, this allocation is generally displayed as a "spinning" of the reels. Regardless, the symbols are mapped to and displayed at each of the respective positions in accordance with the random selection. Paylines are designed along paths defined by the position locations of adjacent reels. Thus, a payline is established by mapping out a line from one position on one reel to another position of the adjacent reel for all of the reels of the game. When combinations of symbols along a payline match a pre-determined combination of symbols, an award is provided to the player if that payline was selected. Selection is made when the player makes a bet on the given payline. The award is associated with the particular combination of symbols and the amount wagered by the player.

An object of the invention is to replace positions of the reels with pluralities of mini-reels. The mini-reels are independent reels. Each randomly allocates only one position and therefore one symbol, which is read in combination with symbols of other positions of the reels to determine if there are any winning symbol combinations. Because there are pluralities of mini-reels, a payline that would otherwise trace its path through the given position now traces its path through each of the mini-reels. Thus, if four mini-reels replace a given position, instead of tracing one payline path through that position, the game now traces four payline paths through each of the four mini-reels; with each of the four mini-reels having an independently selected symbol allocated to the respective position. Thus, four chances exist to receive a winning symbol combination along the payline.

In another object of the invention, a plurality of mini-reels replaces at least one of the reels of the game. At least one of the reels is now defined as a plurality of mini-reels. In this embodiment, all paylines must trace through each of the mini-reels. If there are, for instance, 16 mini-reels replacing one of the reels, then for each payline defined by the game, if selected, 16 separate payline paths would be traced and winning symbol combinations would be assessed for each. The symbols allocated to the reels would remain the same for all of the 16 different payline paths stemming from the one payline, but the symbol allocated to the mini-reels would be considered each of 16 times in combination with those symbols allocated along the payline path for the reels. Thus, there is the possibility of achieving a winning combination along 16 different paths stemming from one payline.

In yet another object of the invention, a bonus or ante bet could enable a plurality of mini-reels to be assigned to replace one of the reels or positions of the reels. The bonus trigger event or the amount wagered might affect the number of mini-reels and/or the number of positions that may be replaced with mini-reels.

Further objects, features, and advantages of the present invention over the prior art will become apparent from the detailed description which follows, when considered with the attached FIGS.

BRIEF DESCRIPTION OF THE DRAWINGS

FIG. 5 shows an exemplary reel-based slot machine game.

FIG. 6 shows an exemplary reel-based slot machine game.

DETAILED DESCRIPTION

Generally, the present invention is directed to a gaming device that improves upon and is associated with the play of a reel-based slot game. In a preferred embodiment, the present invention is a device that possesses the basic functionalities of receiving a wager as a prerequisite to playing a game of chance; operating and displaying a reel-based slot game; and providing a return based on a winning outcome. Therefore, a preferred embodiment is a device or system that is capable of providing wager-based gaming. However, to practice the present invention, wagering need not be based on actual currency as typically used in a casino environment, but can be virtual currency or virtual credit, as typically used in social gaming environments. All that is essentially required is enablement of the operation and display of the game on any device that can support the elements of receiving a wager, whether real or virtual, and providing a return based on a winning outcome.

Figure 1:
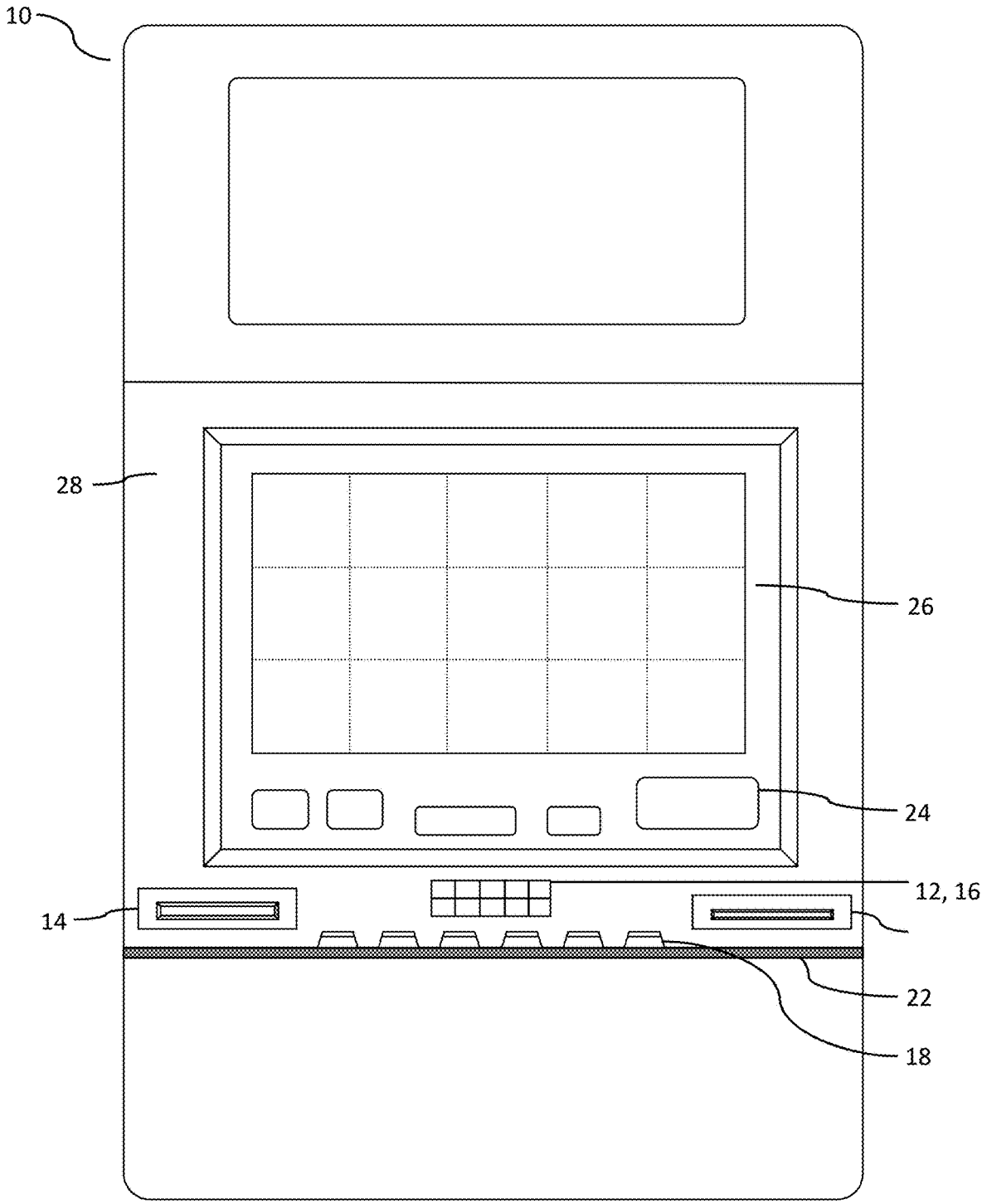
FIG. 1 shows a picture of a typical electronic gaming machine.

A representative device embodying the invention, a conventional slot machine, is displayed in FIG. 1. A slot machine is sometimes referred to as a video-based slot machine, electronic gaming machine, electronic gaming device, or the like, in order to distinguish it from the purely or primarily mechanical-based slot machines of the past. The present invention requires that the device be electronic or electro-mechanical with the ability to display the game through graphic and video images on a computerized display screen. Certain aspects of the slot machine—most of which are inherent in the other devices having a processor, input and output capabilities, and the ability to receive a wager and deliver funds or credits back to a player's account, that may therefore also embody the invention—have bearing on the preferred embodiment of the present invention and thus, a general description inclusive of these features is described.

The slot machine 10 includes a number of input devices. Most of these are typically associated with making a wager. Such input devices include, but are not limited to, a bill validator 12 for identifying and accepting paper currency, a coin acceptor (not shown) for identifying and accepting coin, a card acceptor 14 for reading credit cards, debit cards and other forms of smart cards used for transferring credit or monies, or a cashless ticketing device 16, which may have the dual function of operating as a bill validator 12, which is established through an internally dedicated ticket system that provides for the transfer of coin, currency, or credit to a secure, currency-bearing ticket that may then be used in association with wagering at the slot machine in lieu of currency, coin or cards. The input devices accept the currency, coin, credit, or ticket, respectively, and allocate the specified amounts to the slot machine 10. Such amounts are then made available to a player to make wagers on the play of the game embodied in the slot machine. Additional input devices, including but not limited to buttons 18 and keypads 20 located on the button panel 22 of the slot machine 10 allow the player to select the denomination to be wagered, which, dependent on the denomination selected, causes the amount input to the slot machine to convert to a number of available credits. A credit meter 24 shows the number of credits available for wager at any given time in accordance with the selected denomination. The player may also select through the input devices the number of paylines (later described) on which to wager and the number of credits to wager per payline. The game associated with the slot machine may have a maximum number of paylines and a maximum number of credits that may be wagered per payline to establish an overall maximum wager for each play of a game. Another means for inputting the selection of denomination, number of paylines and the number of credits per payline, or for other required inputs such as volume control or input related to game play activities, is a capacitive surface interface (not shown) associated with the display screen 26. The capacitive surface interface receives input through player touch of the display screen which then localizes the change in capacitance, maps the location, and processes a given input based on the defined location (e.g. denomination, number of paylines, number of credits bet per payline, etc.).

Figure 2:
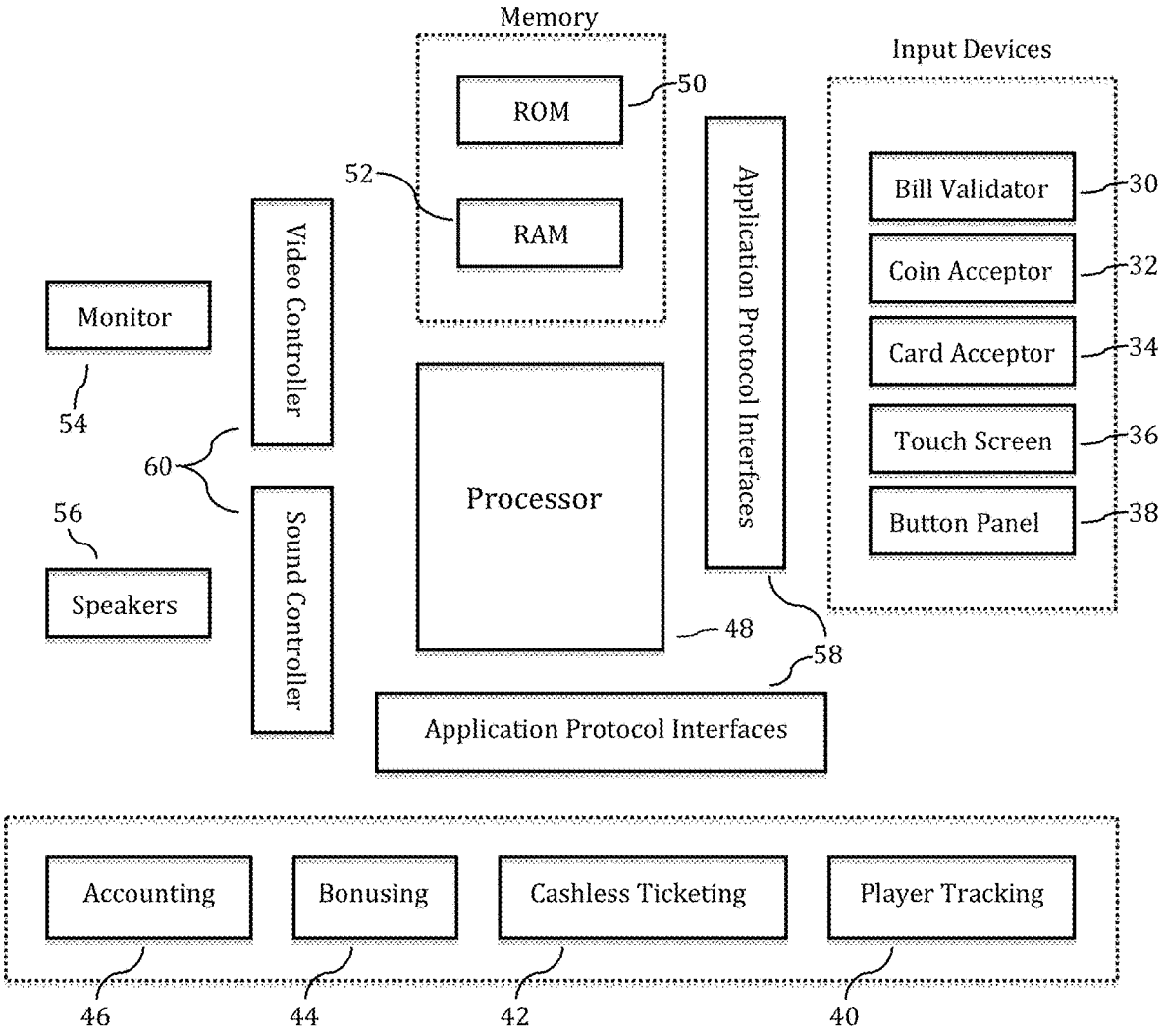
FIG. 2 shows a schematic of a typical electronic gaming machine and its generally associated peripheral devices and systems.

FIG. 2 shows a schematic diagram of many of the primary components, devices and features of the slot machine 10, peripheral devices and associated systems, including the input devices noted above. In addition to the bill validator 30, coin acceptor 32, card acceptor 34, cashless ticketing system 42 and touch screen interface 36, other basic components of the slot machine include at least one processor 48, at least one memory device for storing read only memory (ROM) 50 and for storing random access memory (RAM) 52, and at least one display or monitor 54. The memory 50, 52 stores computer instructions that are executed through the at least one processor 48 to carry out operations communicated to the various devices and components of the slot machine. These instructions include how to accept the currency, coin, credit or currency-bearing tickets and how to handle player input associated with making a wager. The processor 48 reads the applicable input for initiating the play of the game and then processes the game code stored in memory 50, 52 to operate the dynamics of game play. In the event of a winning outcome resulting in a return to the player of a portion, all or multiples of the amount wagered, the processor executes instructions to distribute credits to the credit meter based on the currently selected denomination. Alternatively, and primarily in older model slot machines, the return to the player is provided directly to the player in the form of coins. In these slot machines, there may be only one denomination available and the slot machine may or may not include a credit meter. Input to more modern slot machines linked to a cashless ticking system requesting "cash-out" generally results in a currency-bearing ticket, which can then be redeemed for cash at specialized kiosks that are linked to the cashless ticket system and can identify the ticket and the associated value, or from an operator that can also determine the value of the ticket from a select device linked to the system and therefore provide the applicable amount of currency in exchange for the ticket. Card acceptors 34 are another means, as indicated above, for delivering funds to the slot machine for play and for providing stored amounts back to the card when the player cashes out. Other components associated with the slot machine and gaming activity are further shown in FIG. 2 and include the button panel 38, accounting applications 46, bonusing application 44, player tracking modules 40, speakers 56 for sound, application protocol interfaces (APIs) 58 for communicating information between the various devices and modules and the gaming machine processor 48, and controllers 60 for controlling the display on the monitor 54 and the sound through the speakers 56.

Figure 3:
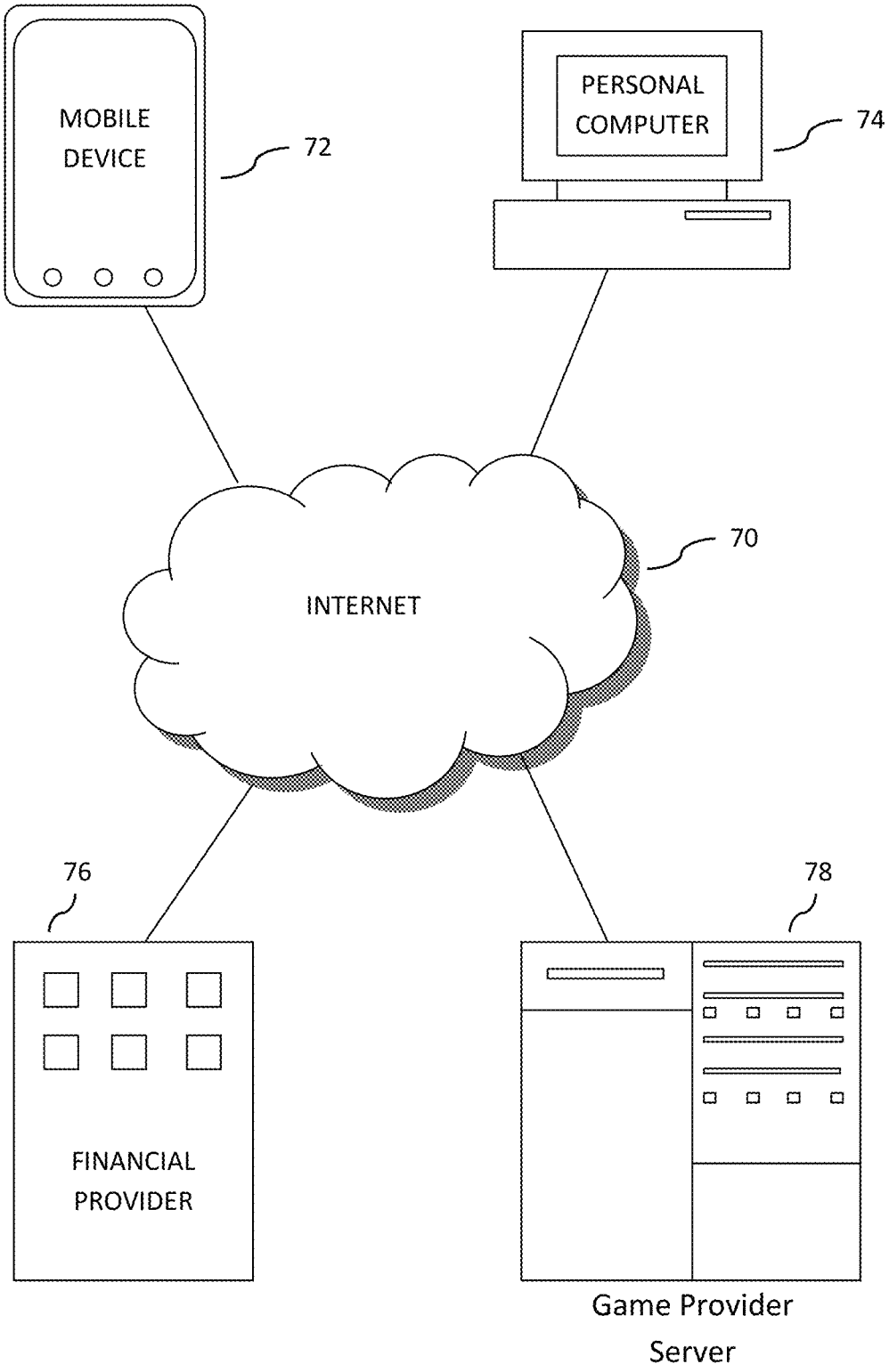
FIG. 3 shows a schematic of a basic gaming system used with personal computers and mobile devices.

Other representative devices that can embody the invention are personal computers and mobile devices, such as smart phones, tablet devices and lap top computers. Use of such devices for wagered gaming has risen in recent years with the advent of the Internet and the legalization of wager-based gaming through the Internet to various locations throughout the world. These devices include many of the same basic elements as the slot machine. However, the secure gaming operations and financial transactions are conducted remotely through a secure server that communicates with the personal computer through the Internet. FIG. 3 generally depicts an Internet-based gaming system. All devices are linked and in communication with the other through the Internet 70. Gaming is conducted on either or both mobile device 72 and personal computer 74.

The input means of a personal computer and mobile device are generally known. They include such components or peripheral devices as a mouse, keyboard, and keypad, but can also include a capacitive surface interface similar to that used with the slot machine display screen. The personal computer 74 and mobile device 72 also include a display screen and at least one processor for computing electronic operations. The personal computer 74 and mobile device 72 access and conduct communications through the Internet 70 or other established wide area network to conduct wager-based gaming. Electronic funds transfer is provided between the player located at the personal computer 74 or mobile device 72 and a financial provider 76 to securely transfer funds to the game provider server 78. Game operations are securely conducted between the game provider 78 and the player to play the game and determine a win or loss. This must be conducted remotely and under a secure server environment as dictated and regulated by applicable gaming authorities.

More specifically, to conduct Internet or networked gaming, the personal computer 74 or mobile device 72 establishes communications with the server 78 of an online game provider by identifying the server by the server's unique uniform resource locator or URL through a web browser and transmitting a call. A web browser, an application stored in the user's personal computer, enables communications through the Internet 70 to other nodes within the network of nodes defining the Internet, including the game provider server 78. Mobile devices use platforms different than browsers, such as iOS for use with Apple mobile devices and Android for use with a variety of other manufacturer's mobile devices, but the purpose and results are substantially similar. Communication links to and from the Internet 70 are established via wire, such as cable, digital subscriber line, or the like, or through wireless transmission such as satellite, Wi-Fi, or the like. Established communication protocols are used to control data download and data upload, and to ensure the nodes can read the data being sent from other nodes. Communications are thus established between the personal computer or mobile device and the online game provider's server. The online game provider houses a repository of virtual wager-based games of chance that a player may select for play. That information is communicated to the mobile device 72 or personal computer 74 and shown on its display. The provider's server 78 also contains the software and content, stored in a memory device, which is processed through one or more processors and streamed or downloaded through the Internet 70 to the personal computer to enable the display and play of the various games. The server 78 maintains the electronic infrastructure to securely conduct financial transactions with a financial provider 76, track the amount of funds deposited to an account established for a given player, use the funds to finance the play of the games, track the deductions and credits to such account based on wagers made and game outcomes, and to process the coded instructions that allow for the play of the game and the determination of game outcomes. After an account is established with the online game provider, currency is deposited through means generally available for making online purchases.

It is also possible to practice the present invention in social gaming. As mentioned above, social gaming, a form of gaming provided online using the Internet, allows for wagering, but only through the use of virtual currency. Virtual currency may then be wagered in lieu of genuine currency, credit or other form of legal tender. Virtual currency is currency that exists and has use only within a social gaming Internet site and no other tradable value. It provides for the play of games or to purchase virtual indicia within the social game to enhance or enable the play of the game; as opposed to genuine currency that is generally available to purchase goods and services of any kind throughout the world. For a game of chance within a social gaming site, the virtual currency can be used in a manner similar to genuine currency such that a player can make a wager on the game in consideration for a chance to receive a winning outcome. A winning outcome may provide additional virtual currency but it is only useable within the social gaming site. Virtual currency is acquired in such a way, but can also be purchased or received as part of a promotion, contest or as a gift. The present invention provides for both the wagering of virtual currency within a social gaming environment and real money wagering within legal gambling jurisdictions and can be practiced in both environments. The game provider generally displays a number of games available for the player to play. The player selects one of the games. The graphical and video representation of the game is streamed through the Internet or wide area network to the player's personal computer or mobile device. An amount specified by the player, or the amount held in the player's account is credited to the video game for play.

Regardless of the device used to embody the invention; be it a slot machine, personal computer, or mobile device, or the means used for initiating a wager, the input and output devices, or the type of display, once the wager is made and play of the game is initiated, the game dynamics are displayed on the at least one display or monitor 28. Additional input may be required during the course of the game. If so, as indicated above, such input is provided, if a slot machine, through the button panel 18 controls or through the touch-screen interface of the monitor 28. Similarly, if a personal computer, through the mouse, keyboard or touch screen and, if a mobile device, through a keypad or touch screen. All of the representative devices possess memory 50, 52 to store computer code and at least one processor 48 to process the operations of the game and include all of the necessary input, output and display elements to securely carry out at least the same primary elements of the present invention. Thus, the functionality to securely process the receipt and delivery of funds, allow a player to make a wager, and to process and display the play of a game. Slot machines, personal computers, and mobile devices can securely perform such functions.

Figure 4:
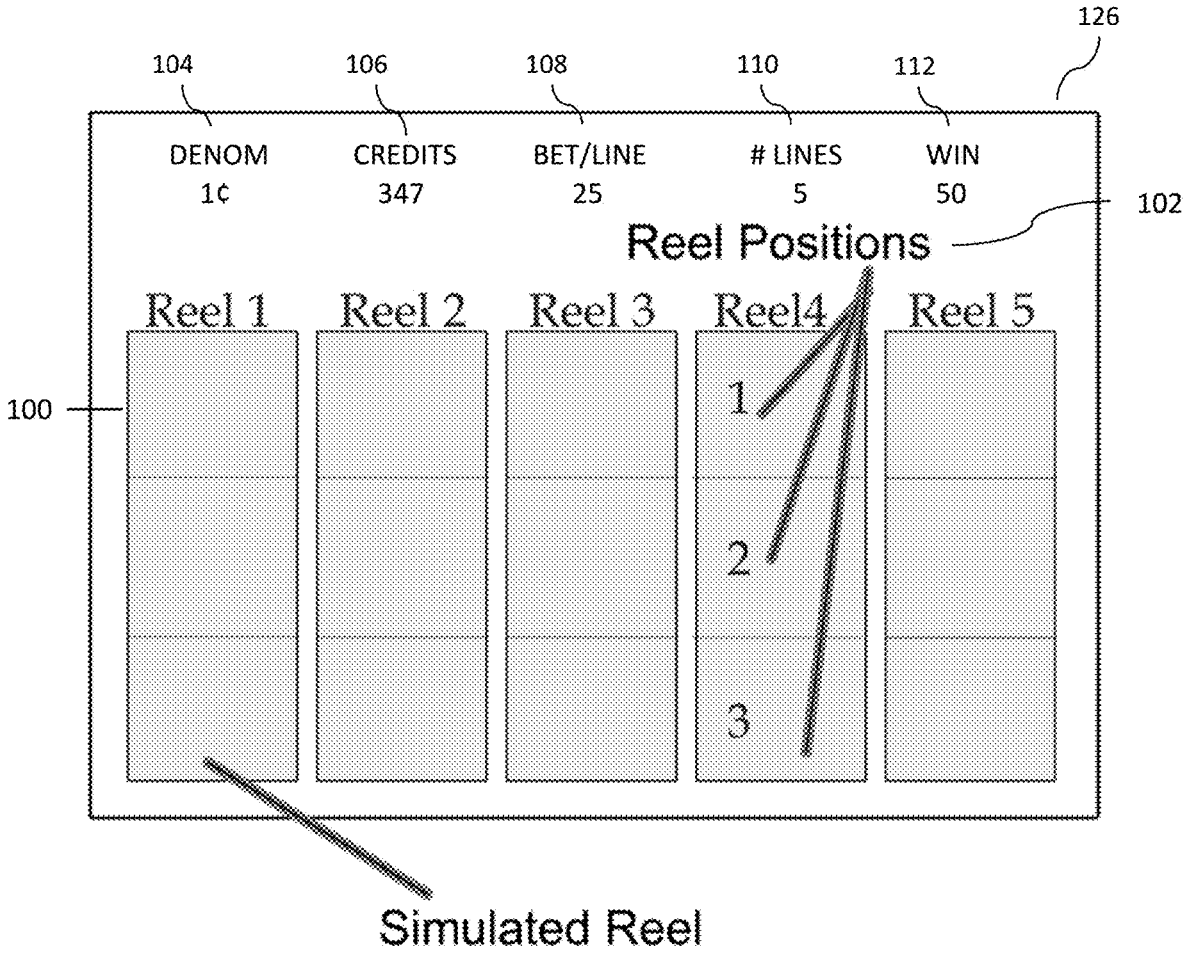
FIG. 4 displays a typical matrix used in reel-based slot machine games.

Referring now to FIG. 4, the game embodied in the slot machine is displayed by the display screen or monitor 126. Similar to a personal computer, the slot machine can embody a number of different applications and, in the instance of a slot machine such applications are associated with a number of different games. Typically, only one game is embodied in the slot machine at any given time, but some slot machines include a number of games that are selectable by the player or operator for play, and some slot machines are linked to a server that allow games to be downloaded to the slot machine from a library of games residing at the server.

The typical slot machine game uses a set of vertically oriented reels 100, indicated in FIG. 4 as Reel 1, Reel 2, Reel 3, Reel 4, and Reel 5. In the electronic gaming machine, the reels are sometimes called simulated reels, video reels or pseudo reels. Each such reel comprises a plurality of positions 102, as indicated in Reel 4, only, of FIG. 4, with a symbol (not shown) residing in each such position, and with only three or four of such positions per reel typically viewable by the user. In FIG. 4, five reels and three rows are shown and active, making this a 3×5 symbol matrix having 15 positions. The reels are aligned adjacent to one another and upon initiation of play are generally simulated to be in rotation, but are nonetheless randomly re-arranging the symbols used in a pre-defined symbol set or sets for random placement in the positions of the matrix. When the rotating reels are stopped, each position is in relative alignment, as shown in FIG. 4, with a position of the adjacent reel or reels. Lines or paylines are then formed as between positions of adjacent reels. Paylines are pre-defined "lines" that consist of positions in each of the reels although not necessarily adjacent positions. For example, with each position labeled according to row number and column number, a payline with all adjacent positions would be 2,1; 2,2; 2,3; 2,4; 2;5. This payline is also the centerline and runs straight across the second row. But another payline might be 1,1; 3,2; 1,3; 3,4; 1,5. This payline has the shape of a 'W' with none of the positions adjacent.

After the simulated rotation of the reels is stopped, if a particular combination of symbols along a payline happens to coincide with a particular predetermined combination of symbols, awards are generally provided. Additionally, if a predetermined number of scatter symbols appear, which are independent of payline, awards are provided for such, too. A random number generator is used to determine the outcome of each play or rotation of the reels. Thus, the set of simulated reels gives the player a visual representation of the outcome generated by the random number generator. This outcome is combined with a set of rules to award a prize.

The monitor 126, as shown in FIG. 4, includes not only the basic elements of the game, such as the simulated reels 100 and the symbols residing therein (not shown), but also other graphical information for keeping track of game play.

The monitor 126 displays the selected denomination 104, the number of player credits 106 remaining on the machine, the bet per line 108, the number of lines selected 110, and the amount of credits won 112 by the player during the last game played. Other information, such as the number of total wager, sound volume, speed of play, and other indicia may also be displayed. A pre-defined number of symbol combination outcomes can be designated for allocation of awards. It is this random outcome that makes each game or each "spin" of the reels unique.

In these games, as more paylines are selected, the wager increases, accordingly. Thus, if one line is selected it will cost one credit if only one credit per line is wagered. If two paylines are selected it will cost two credits and so on. If more than one credit per line is wagered, the wager per line would increase accordingly as will the total wager which, as indicated above, is calculated by multiplying the credit per line times the number of paylines selected.

The reel-based slot machine game uses simulated reels. These are graphic and video representations of both static and animated symbols. When the simulated reel is shown to stop, a symbol (or blank) is displayed and fixed in each position of the reel directly along the centerline. The symbols above or below the center line in each reel are also fixed to those positions on the reel. Thus, there are a number of stops associated with the simulated reel; each stop being associated with a specific symbol. The following is an example of a symbol set that can be used in association with a simulated reel:

For Reels 1-5
S1=Queen
S2=DIAMOND
S3=Jack
S4=BAR
S5=Nine
S6=Jack
S7=King
S8=Ace
(S=Stop)

In this example, all of the five reels use the same reel strip. It is common, however, for different reel strips to be used for each or some of the reels. It is also typical to include more than eight stops, with some stops being "blanks"; i.e. having no assigned symbol. However, for the sake of clarity, the eight stop reel above containing no blanks will be used to help describe the invention.

If the random number generator determines the outcome for this game to have a center line position of:

R1P2=S2
R2P2=S5
R3P2=S2
R4P2=S4
R5P2=S7 where R=reel, P=row and the numbers correspond to the applicable reel or row number, and S=the given stop therefore provide the assigned symbol thereto, then the reels would display the outcome shown in FIG. 5(*a*). Therefore, on the reel 1 in the center position, which is row 2, with S2 being assigned the Diamond symbol, "DIAMOND" appears. Accordingly, S1 being assigned the Queen symbol, "QUEEN" appears in the row land S3 being assigned the Jack symbol, "JACK" appears in row 3. Similarly, on reel 2 in the center position or row 2, S5 being assigned the symbol nine, "NINE" appears in that position and the associated S4—"BAR" and S6—"JACK" symbols appear above and below the center position, accordingly. A similar occurrence would apply for the remaining reels. This is displayed in FIG. 5(*a*), which will discussed in more detail, below.

Traditionally, if the player covers all 5 paylines, and all prizes pay left to right on a selected payline, then the player would be awarded for a combination of three Jacks along payline number 3, accordingly. In this example, payline number one is the centerline or R1P2, R2P2, R3P2, R4P2, R5P2. Payline number 2 is R1P1, R2P1, R3P1, R4P1, R5P1, payline number 3 is R1P3, R2P3, R3P3, R4P3, R5P3, payline number 4 is R1P1, R2P1, R3P3, R4P2, R5P1, and payline number 5 is R1P3, R2P2, R3P1, R4P2, R5P3. If the award for a combination of three Jacks in a row along a payline is five credits, then five credits would be awarded and the game would end. If a wager is made on all five paylines, then the total amount wagered for all paylines would equal the award received for the one payline having the three jacks, and thus the credit meter would remain unchanged.

The player could have also chosen to play multiple credits per line. This method of wagering simply multiplies the win by the number of credits staked per line. Thus, if the player chose to wager five credits per line, then the win in the above example would be 25 credits (i.e. five credit bet multiplied by five credits per win=25 credit win).

Although the above example was described with eight symbols in the symbol set with each symbol other than the Jack symbol occurring once, the symbol set can be made up of any number of symbols and blanks with each weighted differently for possible random selection. Therefore, where one symbol in the symbol set might have, say, a 1% chance of selection for a given reel, another symbol or a blank in the same symbol set might have, say, a 30% chance of selection. Symbol combinations or scatters wins using the symbol having the 1% chance of selection would most likely provide higher awards due to the lesser chance of occurrence. Additionally, the symbol sets and chance for selection could vary with respect to each column. Thus, it is not a requirement of the invention that the symbols be allocated in such a manner described above and that allocation is described merely as an example. The symbol-matrix game may also include any manner of randomly allocating symbols to the fields of the matrix, including the manner provided, above.

The random number generator randomly selects the symbols from the symbol set(s) to be displayed in each of the positions of the respective columns. Winning outcomes are then determined by determining the symbol combinations generated along the five pre-defined and player selected paylines. These payline paths, as well as the number of paylines, are pre-defined and set as constant parameters of the game but only made active if selected and wagered upon by the player.

The presently described game may allow a player to select one or more paylines for play, but only up to the maximum of five paylines in this embodiment. Player input generally required to initiate game play is the selection of a number of paylines on which the player wishes to make a wager and then the number of credits to be assigned to each of those paylines. Thus, a wager is placed per payline as well as a total wager for the entire play of the game based on the credit amounts and the denomination assigned to each credit. Further input may be required such as a "start" or "spin" button to then "spin the reels" and randomly populate the fields of the matrix' columns with the symbols allocated from the applicable symbol sets (with only one set described in this embodiment). The comparison is performed as between the symbol combination outcomes along actively selected paylines and to a table of pre-determined winning outcomes defined by the game. If a match is found, an award is provided to the player. Multiple awards may be provided if more than one payline includes a winning symbol combination. Although the above is a description of a basic reel-based game, the present invention may be practiced in conjunction with numerous variations of, or additional features to the above described game. The present invention can be practiced with any reel-based game that includes a plurality of positions and that are randomly populated with symbols (or other indicia). For instance, the matrix of positions may be rectangular, as is the 3×5 matrix described above, or of any shape.

The present invention encompasses a plurality of mini-reels, which will be later described, to replace one or more of the five reels or one or more of the positions of a reel. Each reel that is replaced by a plurality of mini-reel is referred to hereinafter as a Reelfecta™ reel. A Reelfecta reel increases or at least provides the appearance of increasing the chances to obtain a win and provides a new feature and improvement on the standard reel-based slot game that results in more excitement and enjoyment for the player.

Figure 7:
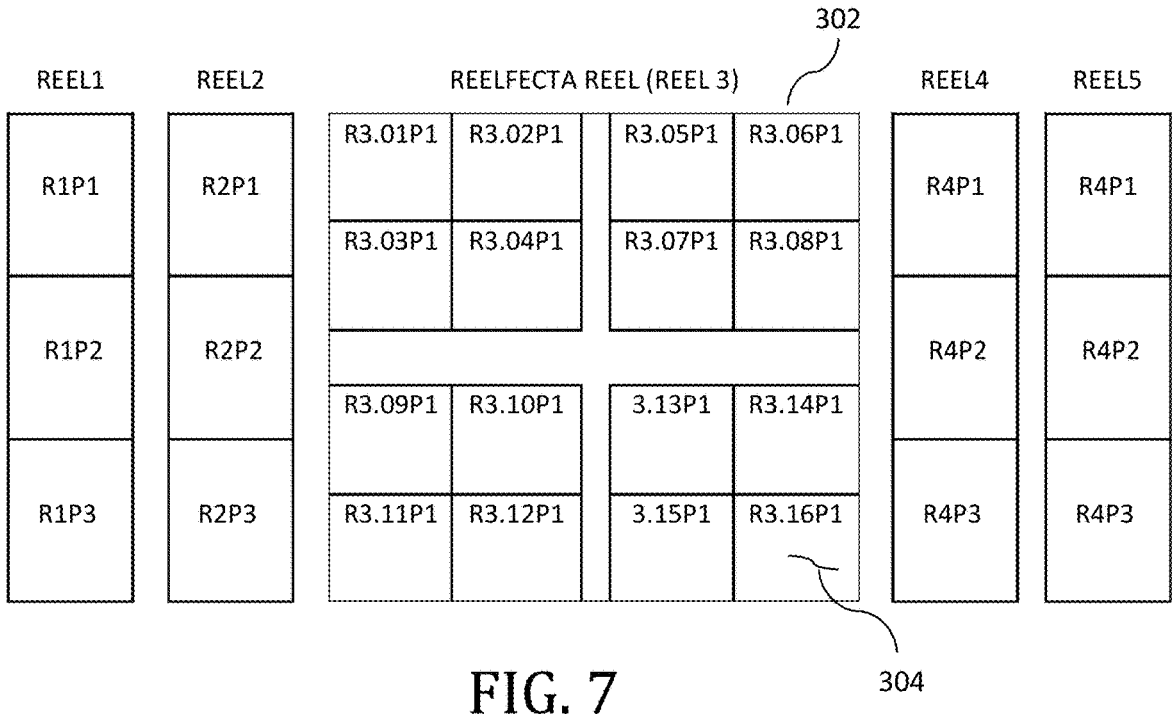
FIG. 7 shows an exemplary reel-based slot machine game outlay having a Reelfecta reel.

In a preferred embodiment shown in FIG. 7, the Reelfecta reel 302 is used on one reel—reel 3—and includes 16 distinct mini-reels 304. Each of the mini-reels 304 is provided its own designation and its own symbol set, which may be the same symbol set used with some or all of the non-Reelfecta reels. Each of the mini-reels acts independent of the other reels. Therefore, independent of each other mini-reel and the non-Reelfecta reels. Thus, upon initiation of the game, the random number generator similarly selects the symbol outlay for each of the mini-reels in a manner similar to that of the non-Reelfecta reels. The outcome of each mini-reel is assessed in combination with the outcomes from each of the non-Reelfecta reels to determine symbol combinations that involve a win. By adding 16 mini-reels 304 to reel 3, as shown in FIG. 7, the winning combinations can now potentially appear, given the appropriate winning symbol combinations in the respective payline positions, along any one of the following:

Reel 1, Reel 2, Reel 3.01, Reel 4, Reel 5
Reel 1, Reel 2, Reel 3.02, Reel 4, Reel 5
Reel 1, Reel 2, Reel 3.03, Reel 4, Reel 5
Reel 1, Reel 2, Reel 3.04, Reel 4, Reel 5
Reel 1, Reel 2, Reel 3.05, Reel 4, Reel 5
Reel 1, Reel 2, Reel 3.06, Reel 4, Reel 5
Reel 1, Reel 2, Reel 3.07, Reel 4, Reel 5
Reel 1, Reel 2, Reel 3.08, Reel 4, Reel 5
Reel 1, Reel 2, Reel 3.09, Reel 4, Reel 5
Reel 1, Reel 2, Reel 3.10, Reel 4, Reel 5
Reel 1, Reel 2, Reel 3.11, Reel 4, Reel 5
Reel 1, Reel 2, Reel 3.12, Reel 4, Reel 5
Reel 1, Reel 2, Reel 3.13, Reel 4, Reel 5
Reel 1, Reel 2, Reel 3.14, Reel 4, Reel 5
Reel 1, Reel 2, Reel 3.15, Reel 4, Reel 5
Reel 1, Reel 2, Reel 3.16, Reel 4, Reel 5

Thus, whereas paylines passing through Reel 1, Reel 2, Reel 4 and Reel 5 require an assigned position or row, Reel 3 does not. All paylines run through each of the mini-reels of the Reelfecta reel 302.

This, if only one payline—payline number 1, the center payline—is selected and wagered upon, only the payline consisting of row 2 in Reels 1, 2, 4 and 5 will be assessed for winning combinations, but in conjunction with each of reels 3.01 through 3.16. Therefore, the sixteen different combinations:

R1P2; R2P2; R3.01P1; R4P2; R5P2
R1P2; R2P2; R3.02P1; R4P2; R5P2
R1P2; R2P2; R3.03P1; R4P2; R5P2
R1P2; R2P2; R3.04P1; R4P2; R5P2
R1P2; R2P2; R3.05P1; R4P2; R5P2
R1P2; R2P2; R3.06P1; R4P2; R5P2
R1P2; R2P2; R3.07P1; R4P2; R5P2
R1P2; R2P2; R3.08P1; R4P2; R5P2
R1P2; R2P2; R3.09P1; R4P2; R5P2
R1P2; R2P2; R3.10P1; R4P2; R5P2
R1P2; R2P2; R3.11P1; R4P2; R5P2
R1P2; R2P2; R3.12P1; R4P2; R5P2
R1P2; R2P2; R3.13P1; R4P2; R5P2
R1P2; R2P2; R3.14P1; R4P2; R5P2
R1P2; R2P2; R3.15P1; R4P2; R5P2
R1P2; R2P2; R3.16P1; R4P2; R5P2 with R=reel, P=row and the numbers corresponding to such reel or row, will be assessed for winning combinations as opposed to one; i.e. R1P2 R2P2, R3P2, R4P2, R5P2, if there were no Reelfecta reel. If three paylines are selected, a total number of combinations assessed for payline wins would be 48, three paylines multiplied by 16 possible combinations per payline as provided by the Reelfecta reel.

As indicated above, since the positions on the Reelfecta reel are individual reels, it is possible to win the same symbol on as little as one mini-reel or as many as 16 mini-reels on this third reel.

One advantage of this invention is that it allows for many different levels of pays on the one simulated spin or play of the reel-based slot game. In regular games a player might receive, for instance, an award from a combination of three Jack symbols in a row along a selected payline from the reel 1 to reel 3, normally paying five credits. However, using the Reelfecta reel, assuming the player has a Jack in the correct position on reel 1 and reel 2, the prize the player can expect would be anywhere between five credits, if they receive just one Jack on the Reelfecta reel, to 40 credits if they happened to match eight Jacks on the $3^{rd}$ or Reelfecta reel (i.e. 5 credits×8 occurrences=40 credits), or even 80 credits if they were to achieve 16 Jacks on the 3 reel (i.e. 5 credits×16 occurrences=80 credits). Since the winning symbol can appear anywhere within the Reelfecta reel, the player can feel a real chance of winning the necessary symbol on the Reelfecta reel.

By using wild symbols in the symbol set for the Reelfecta reels; i.e. a symbol that can replace some or all of the other symbols of the symbol set, multiple wins for multiple symbols can be achieved. This makes the game very exciting as the number of potential wins is greatly increased with the use of so many extra mini-reels on the Reelfecta reel. Another advantage of the invention is that it becomes visually clear to the player if they are going to receive none, some or, if the Reelfecta reel uses 16 mini-reels, or all of the 16 wins, as they can see how many times the matching symbols appears anywhere on the Reelfecta reel. This results in a lot more "action" for the player, allowing for a more thrilling experience.

An example of game play using an embodiment of the present invention will now be discussed in reference to FIG. 8. The game is initiated and the random number generator selects symbols for all positions. In a preferred embodiment, 16 different random number generator selections will occur for each of the 16 positions representing the 16 mini-reels on the Reelfecta reel. Additionally, the random number generator will randomly select the symbol outcomes for each of reels 1, 2, 4 and 5. Thus, symbols in the respective positions might be randomly determined along the center payline as follows:

| Position | Stop |
|---|---|
| R1P2 | S2 |
| R2P2 | S5 |
| R3.01 | S1 |
| R3.02 | S6 |
| R3.03 | S2 |
| R3.04 | S5 |
| R3.05 | S6 |
| R3.06 | S7 |
| R3.07 | S4 |
| R3.08 | S8 |
| R3.09 | S2 |
| R3.10 | S3 |
| R3.11 | S8 |
| R3.12 | S6 |
| R3.13 | S4 |
| R3.14 | S1 |
| R3.15 | S4 |
| RS3.16 | S3 |
| R4P2 | S4 |
| R5P2 | S7 |

With the Reelfecta reel having a generic or the same position since all paylines pass through each of the mini-reels of the Reelfecta reel.

With the reel position outlay for each reel still consisting of the sequence noted above and shown again as:

S1=Queen
S2=Diamond
S3=Jack
S4=Bar
S5=Nine
S6=Jack
S7=King
S8=Ace

Figure 8:
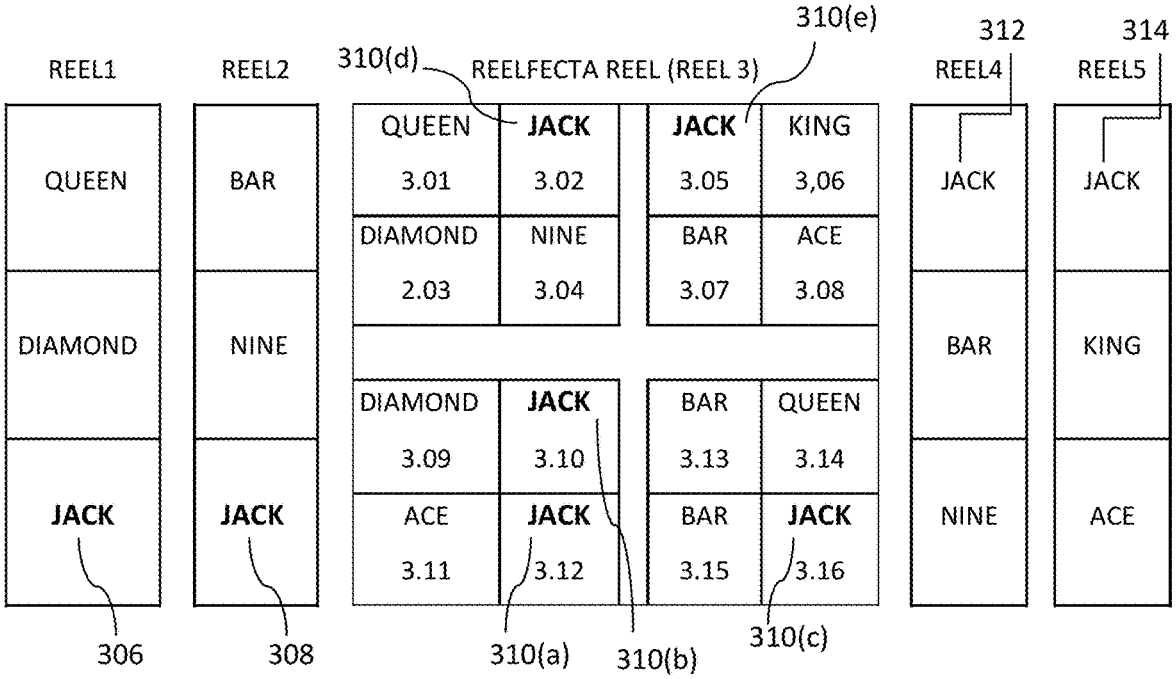
FIG. 8 shows an exemplary reel-based slot machine game utilizing a Reelfecta reel.

The symbol outlay would appear as shown in FIG. 8. As shown in FIG. 8, if the game is a five-line game, line three, which consists of the position in row three on each of reels 1, 2, 4 and 5, will pay an award for the Jack symbol appearing three times in succession along the payline—a winning outcome in this example paying five credits per credit wagered. Since the award for three symbol combination of Jacks is five credits, the total award in this example is 25 credits since a Jack 306 appears in R1P5, a Jack 308 appears in R2P5, and Jack 310(*a*)-(*e*) was selected five of the sixteen possible times by the random number generator representing each of the sixteen mini-reels.

If the game were a scatter-type game, thereby providing value to symbols regardless of payline, then the two Jack symbols 312, 314 shown in FIG. 8 in the R4P1 and R5P1 positions would be considered and the game would then pay the award associated with five Jack symbols in a row; being paid five times in this instance due to the 5 Jacks appearing on the Reelfecta reel.

Figure 9:
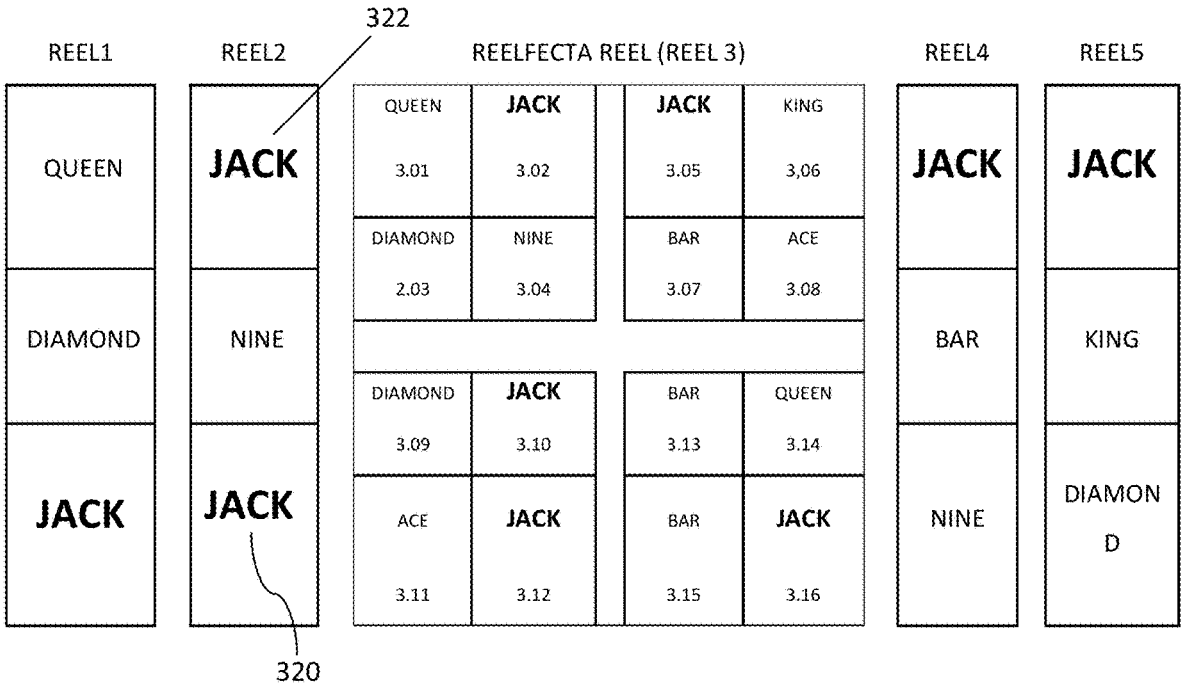
FIG. 9 shows an exemplary reel-based slot machine game utilizing a Reelfecta reel.

In another example shown in FIG. 9, two Jack symbols 320, 322 appear on reel 2, in this example, which then doubles the number of at least scatter-based awards (the payline award would also be doubled if a payline was defined as including the R1P3, R2P3, R4P1, R5P1 positions and was selected by the player). So in the example shown in FIG. 9, the Jack symbol combinations would be paid 10 times, five times for each Jack appearing on reel 2. Specifically, the player would be paid for the following combinations:

R1P3; R2P3; R3.02; R4P1; R5P1
R1P3; R2P3; R3.05; R4P1; R5P1
R1P3; R2P3; R3.10; R4P1; R5P1
R1P3; R2P3; R3.12; R4P1; R5P1
R1P3; R2P3; R3.16; R4P1; R5P1
R1P3; R2P1; R3.02; R4P1; R5P1
R1P3; R2P1; R3.05; R4P1; R5P1
R1P3; R2P1; R3.10; R4P1; R5P1
R1P3; R2P1; R3.12; R4P1; R5P1
R1P3; R2P1; R3.16; R4P1; R5P1

Many embodiments of the invention can take place other than those described, above. As previously indicated, there can be more or less mini-reels on the Reelfecta reel and there may be more than one Reelfecta reel within the game. Additionally, one or more positions could be expanded into a plurality of mini-reels. The Reelfecta reel might be a feature of the reel-based slot machine game or a feature of a bonus game that is triggered to occur randomly or upon the occurrence of a certain event. The number of mini-reels and/or Reelfecta reels could be randomly determined in such an event or dependent on various criteria, including the outcome of the base game result. By way of example, a specified symbol in the symbol set might trigger a position to expand into a plurality of mini-reels or cause the reel upon which it resides to become a Reelfecta reel. The number of mini-reels used with the Reelfecta reel or at a specified position might also be randomly based or dependent on underlying criteria. For instance, if a base game result triggers a Reelfecta reel, one base game outcome might produce eight mini-reels encompassing the Reelfecta reel while another base game outcome might produce 16 mini-reels. A similar result could occur for symbol triggering mini-reels. One trigger might produce four mini-reels at a given position while another triggering symbol might product eight mini-reels. Numerous embodiments involving a plurality of mini-reels could be developed by those skilled in the art.

In order to profitably conduct business in the wagered-gaming markets (and also to operate virtual casinos used in the social gaming markets) for their respective owners and operators, the devices must retain on average a percentage of the monies wagered by the players. This amount is referred to as the hold percentage, hold, or the win per unit. The converse of the hold percentage is the average percent return to player ("RTP"); also referred to as the payout percentage or the expected return. The allowable percentages are generally dictated through the laws, rules or regulations enacted by local gaming authorities authorized to make such for a given wagered gaming jurisdiction. Stated differently, over an infinite number of plays of a game, the amount of money, coin or credit, as applicable, returned to the player from the aggregate of all winning outcomes will be less than the amount of money wagered by the player. The percentage difference between the amount wagered and the amount returned to the player is the hold percentage, and is the percentage amount retained by the game provider.

Ideally a game's return to player should be between 85% and 98% to allow the casino running the game to earn satisfactory revenue while returning a legally required amount to the players while giving the player a feeling of getting value in return for their investment. In order for a game designer to calculate the RTP of a game that makes use of a Reelfecta reel, one method is to treat each mini-reel in association with each of the paylines as having a separate RTP. The return from each of the individual reel returns is then added together to get the RTP of the game.

If the odds along a given payline of achieving desired symbols to obtain a winning outcome for each of the mini-reels are the same as those of achieving the desired symbols on a non-Reelfecta reel, then given the plurality of chances of achieving the winning outcome using a Reelfecta reel, the RTP would increase—16 times in the heretofore discussed embodiment (given 16 mini-reels on the Reelfecta reel). To compensate and return the RTP back to the desired 85%-98%, the game designer might require a higher wager to play a Reelfecta reel game. As an example, if for each mini-reel in the heretofore discussed embodiment, the RTP was 225%, the RTP for the game would be 3,600% (i.e. 16 mini-reels, each associated with a 225% RTP, multiplied times by the RTP of 225%). To compensate, the minimum bet can be increased without multiplying winning outcomes, accordingly, by the increased bet multiple. Thus, in this example, the minimum bet to play the game would be 40 credits, but the award for winning outcomes would be based on a one credit bet. Therefore, the RTP would be reduced back to 90% (3600%/40 credits=90%). If a player desired to risk a greater amount for a greater potential return, they could bet multiples of 40. With a 80 credit bet, the player would have winning outcomes multiplied by two; with a 120 credit bet, by three, etc.

Another way to reduce the return to player is to reduce the awards. Even with only the center line selected as a payline, including all positions on the Reelfecta reel, the player would still be paid up to 16 times. Therefore to compensate for the increased number of times the win can be paid, the prizes can be reduced accordingly, when using a Reelfecta reel.

In yet another means, the odds of selecting particular symbols to achieve winning outcomes could be modified, accordingly, on either or both the reels or the mini-reels. An astute game designer will also know that the results can be adjusted by changing the number of symbols appearing on a reel strip so that it is more difficult to line up winning combinations—thereby reducing overall return.

To add further flexibility into the wagering structure of the game, the player could choose different wagers based on the number of reels they would like to add to the Reelfecta reel. For example, in the described embodiment, the game designer may allow the player the option to choose only four out of the 16 mini-reels within the Reelfecta reel; i.e. 25% of the available mini-reels. Using the previous example, the RTP of playing four reels would be 9000/% (4×225%), The wager to play only four mini-reels of the 16 available or 25% of the mini-reels would be 10 credits (25% of 40 credits=10 credits), thereby reducing the overall return of the game to 90%. (900%/10 credits). The cost to the player is less than when covering all the mini-reels. However, it will also be obvious to the player that they have less chances of winning, as three quarters of the mini-reels will not be in play. Mini-reels that are not in play may be represented by being covered with a semi transparent overlay, indicating that those symbols will not be used in calculating awards on the Reelfecta reel. The player would need to increase their bet back up to 16 credits to fully uncover the inactive mini-reels.

Although this example shows four mini-reels in play, any number of mini-reels may be switched on or off. The touch screen interface or button panels may be used to allow the player to choose which positions the player wishes to make into an active Reelfecta reel, which mini-reels to make active in the Reelfecta reel, or which positions the player would rather turn into a plurality or mini-reels.

In another embodiment, each mini-reel could have its own RTP, allowing greater flexibility for the game designer to adjust the overall RTP depending on the wager. For instance the RTP on mini-reels 1-4 may be only 220% on each mini-reel. So the overall percentage when playing only reels 1-4 with the cost of 10 will provide a RTP of 88% (220×4/10). The RTP on reels 5-16 might be 240% on each mini-reel. Overall percentage on all mini-reels play is (4×220)+(12×240)=3760/40=94%. So when the player covers all 16 reels, they are rewarded with a higher return (94%) for their bigger bet (40 Credits). This potential flexibility in RTP is an added advantage to game designers who are often looking for different ways to improve the RTP to players who wager more, but without discouraging players who wager less and who think they are not getting as good a value for their money as the players who make larger wagers.

Another advantage of using Reelfecta reels is with the use of the bonus or jackpot triggering awards, which are often triggered by a scatter prize. Currently the number of scatters is generally limited to the number of reels because generally only one can appear on each reel at the same time. Most standard games only have five reels. This limits the number of scatter symbols to five. There are games where this does not apply, such as 16 reel games (with a 4×4 reel matrix), or where scatters symbols are stacked. However these types of games are not common.

With Reelfecta reels we can put one scatter symbol on each of the mini box reels. In this example you could have one scatter symbol per reel or mini-reel, meaning up to 20 scatter symbols (one on reel 1, one on reel 2, one on each of the 16 mini-reels on reel 3 (the Reelfecta reel), one on reel 4 and one on reel 5). Scatter symbols might also be placed on only certain mini-reels of the Reelfecta reel. Since there can be many more reels that can contain a scatter, this can add excitement as it allows for a lot more scatter symbols to appear, exciting the player when they see so many scatter bonus triggering symbols appearing.

Having so many extra symbol areas to work with also allows for interesting and exciting ways of triggering a jackpot. The extra number of combinations given by the Reelfecta reel system means that a game designer could potentially award a mega jackpot if the player, for instance, achieved a certain symbol in every position within the Reelfecta reel; or if certain patterns were achieved, to award different jackpots. For instance if the wild symbols appeared to make a diamond shape, the maxi jackpot could be awarded. Since the player could often come very close to filling up most of the pattern, excitement and anticipation is enhanced.

In another embodiment, a triggering event could cause the mini-reels to include symbols that when each is displayed, make up a new picture. For instance each mini-reel is a piece of a puzzle and when all puzzle pieces are shown, the full picture is displayed. Thus, when half of the individual reels are showing respective pieces of the puzzle, the full picture will not be shown, however the player will make out what the picture is supposed to be. The symbols may, for instance spin to make the puzzle pieces of a car. If all symbols match up to exactly make up the car picture, the prize of a car is won.

Alternatively, the mini-reels may contain a transparent blank symbol that when "shown", reveals a picture behind the reels. In both cases, the parts of the picture symbol will be considered to make up the winning combination on the reel. A further special prize may be awarded when some or all parts of the picture are revealed.

In yet another embodiment, a bonus round may make use of the Reelfecta reel. During free games one or more of the mini-reels would be held for the duration of the free games. This is particularly enticing if the held symbol is a wild symbol. Further reels maybe locked in during the free spins so that the player can see that any winning combinations can be guaranteed to be paid multiple times, due to multiple held wild symbols.

In another embodiment, the player could make an ante bet to select one or more positions or reels to be replaced with a plurality of mini-reels or a Reelfecta reel. This could also occur as a bonus event or other type of award. The player could use the touch screen to select which position(s) or reel(s) to change to mini-reels or a Reelfecta reel.

There is a growing need of finding a way to increase the chance, or at least to create the perception of an increased chance, for the players of reel-type games, of winning a particular prize or feature, before the user gets bored. The Reelfecta invention addresses this need.

It will also be appreciated that the examples shown here are illustrative and not intended to be restrictive. It is noted that the invention could be implemented in numerous ways.

It will be understood that the above described embodiment and arrangements are not to be construed as limiting, but rather as being merely illustrative of applications of the principles of this invention and that many other embodiments and modifications, including those described herein, may be made without departing from the spirit and scope of the invention as defined in the claims.

What is claimed is:

1. A gaming device used by a player for the operation of electronic game play comprising:

at least one fund-receiving mechanism for receiving funds and establishing a monetary credit associated with said gaming device;

at least one memory storage location for storing instructions associated with a game;

at least one processor;

at least one data input mechanism for allowing said player to input data associated with said game including a wager amount drawn from said monetary credit; and at least one display device, wherein upon input associated with said game including said wager amount, the instructions are executed by the at least one processor to display on the display device: (i) a plurality of positional sets with each of said positional sets comprising a plurality of positions wherein the positions of at least one of said positional sets comprises segments of a simulated reel strip and the positions of at least one other of said positional sets comprises a plurality of simulated mini-reels, and (ii) a symbol residing within each of said positions, said symbol randomly selected from a symbol set;

a payline defined by the selection in a predetermined order of one of the positions from each of the positional sets that comprise segments of a simulated reel strip and one of the positions from each of the positional sets that comprise a plurality of simulated mini-reels;

a payline set comprising all combination of positions of said payline wherein the position from each of the positional sets that comprise segments of a simulated reel strip remains the same for each of said combination of positions and one of the positions from one of the positional sets that comprise a plurality of simulated mini-reels is different for each of said combination of positions;

at least one predetermined winning symbol combination comprised of an arrangement of specified symbols from said symbol set wherein said controller:

(i) reads each of said symbols from each of said combination of positions in said predetermined order;

(ii) determines if the arrangement of said symbols from each of said combination of positions matches any of said at least one predetermined winning symbol combinations;

(iii) awards the player a pre-determined award value for each arrangement of said symbols that match one of said at least one predetermined winning symbol combinations.

2. The device of claim 1 further comprising a plurality of pre-determined values wherein each of said pre-determined values is associated with one of said at least one predetermined winning symbol combinations.

3. The device of claim 1 wherein at least one of said positional sets comprised of simulated mini-reels changes from a positional set comprised of segments of a simulated reel strip to simulated mini-reels upon the occurrence of a trigger event.

4. The device of claim 1 wherein said payline set comprises less than all of said combination of positions of said payline.

5. The device of claim 1 wherein the positional set comprised of said positional set comprised of segments of a simulated reel strip converts to said positional set comprised of said plurality of mini-reels after display of a special symbol within said positional set comprised of segments of a simulated reel strip.

6. A gaming device used by a player for the operation of electronic game play comprising:

at least one fund-receiving mechanism for receiving funds and establishing a monetary credit associated with said gaming device;

at least one memory storage location for storing instructions associated with a game;

at least one processor;

at least one data input mechanism for allowing said player to input data associated with said game including a wager amount drawn from said monetary credit; and at least one display device, wherein upon input associated with said game including said wager amount, the instructions are executed by the at least one processor to display on the display device: (i) a plurality of positional sets with each of said positional sets comprising a plurality of positions wherein at least one of the positions from at least one of the positional sets comprises a plurality of simulated mini-reels with the remainder of the positions comprised of segments of a simulated reel strip wherein each of said mini-reels further comprises one of said plurality of positions, and (ii) a symbol residing within each of said positions, said symbol randomly selected from a symbol set;

a payline defined by the selection in a predetermined order of one of the positions from each of the positional sets;

a payline set comprising all combination of positions of said payline wherein the positions that are segments of a simulated reel strip remain the same for each of said combination of positions and one of the positions from the at least one of the plurality of simulated mini-reels are different for each of said combination of positions;

at least one predetermined winning symbol combination comprised of an arrangement of specified symbols from said symbol set wherein said controller:

(i) reads each of said symbols from each of said combination of positions in a predetermined order;

(ii) determines if the arrangement of said symbols from each of said combination of positions matches any of said at least one predetermined winning symbol combinations;

(iii) awards the player a pre-determined award value for each arrangement of said symbols that match one of said at least one predetermined winning symbol combinations.

7. The device of claim 6 further comprising a plurality of pre-determined values wherein each of said pre-determined values is associated with one of said at least one predetermined winning symbol combinations.

8. The device of claim 6 wherein said payline set comprises less than all of said combination of positions of said payline.

9. The device of claim 6 wherein a special symbol displayed within one of said segments of a simulated reel triggers the replacement of said segment with said plurality of mini-reels.

10. The device of claim 9 wherein said special symbol is one of a plurality of special symbols and the number of said plurality of mini-reels is dependent on the special symbol that is displayed.

* * * * *